US005320267A

United States Patent [19]

Oono et al.

[11] Patent Number: 5,320,267

[45] Date of Patent: Jun. 14, 1994

[54] WEB TRANSPORT APPARATUS

[75] Inventors: Seiichi Oono; Hiroshi Nakajima; Masayuki Kawarada; Hiroki Saito, all of Kanagawa, Japan

[73] Assignee: Fuji Photo Film Co., Ltd., Kanagawa, Japan

[21] Appl. No.: 605,307

[22] Filed: Oct. 30, 1990

[30] Foreign Application Priority Data

Oct. 31, 1989 [JP] Japan ..... 1-282032

[51] Int. Cl.[5] ..... D05B 35/00

[52] U.S. Cl. ..... 226/170; 226/53; 226/80; 226/82; 226/5; 26/86; 26/90

[58] Field of Search ..... 226/52, 53, 74, 76, 226/80, 170, 5, 82, 85; 26/52, 53, 86, 90

[56] References Cited

U.S. PATENT DOCUMENTS

| | | | |
|---|---|---|---|
| 1,233,257 | 7/1917 | Lewis | 26/53 |
| 2,100,535 | 11/1937 | Boggs | 226/85 |
| 2,705,880 | 4/1955 | Kinzinger et al. | 26/52 X |
| 2,743,438 | 11/1955 | Meier-Windhorst et al. | 26/86 |
| 3,111,249 | 11/1963 | Lazar | 226/85 |
| 3,604,078 | 9/1971 | Sciola et al. | 26/52 X |
| 3,703,914 | 11/1972 | Freisler | 139/308 |
| 3,887,121 | 6/1975 | Reich | 226/53 |

FOREIGN PATENT DOCUMENTS

| | | | |
|---|---|---|---|
| 1226068 | 12/1962 | Fed. Rep. of Germany | 226/5 |
| 1915995 | 10/1970 | Fed. Rep. of Germany . | |
| 698199 | 1/1931 | France | 26/57 |
| 965124 | 9/1950 | France . | |
| 178155 | 7/1990 | Japan . | |
| 182654 | 7/1990 | Japan . | |
| 182655 | 7/1990 | Japan . | |

*Primary Examiner*—Daniel P. Stodola
*Assistant Examiner*—Paul T. Bowen
*Attorney, Agent, or Firm*—Sughrue, Mion, Zinn, Macpeak & Seas

[57] ABSTRACT

A web transport apparatus that will not cause the web to break by exerting external forces in different ways on two lateral sides. The transport apparatus includes a group of pins that are studded on flat plates connected together to form a chain on either side of a web so that it is transported in multiple stages as it is retained on two lateral sides. An annular member supports the web from the inside by pins in each of the reversing sections that rotate to reverse the direction of web transport, with the piercing end of each pin facing either inward or outward. The annular member has a central shaft located at the center of the locus of rotation of the flat plates and has an outside diameter substantially equal to the diameter of the locus of rotation of the web. Preferably, the annular members rotate at the same speed as the web. There further may be provided a separating section at which the web is disengaged from the pins, which section is provided in the last reversing section which rotate with the piercing ends of pins facing outward. The annular member in the last reversing section preferably has an outside diameter equal to or greater than the diameter of the locus of rotation of the piercing ends of the pins.

12 Claims, 4 Drawing Sheets

WEB TRANSPORT APPARATUS

BACKGROUND OF THE INVENTION

The present invention relates to an apparatus in which supports in long strip form, such as textiles and plastic sheets (which are hereinafter referred to as "a web" or "webs"), are transported for stretching on a tenter with their trailing edges properly retained. More particularly, the present invention relates to a web transport apparatus in a pin tenter that is used to dry and transport webs with care being taken to prevent them from shrinking in the direction of width.

The web transport apparatus used in conventional tenters is composed of a group of clips or pins that are installed on flat plates connected together to form a chain on either side of a web so that the latter will run along a straight line as it is retained on two lateral sides. This apparatus, which employs a linear transport method, is limited in length and, hence, in the speed at which it can dry and transport webs. However, the drying and transport speed has to be increased in order to reduce the cost of products.

With a view to solving those problems, it has been previously proposed to employ a multi-stage web transport apparatus having reversing sections (I, II) as shown in FIG. 1 (and as disclosed in commonly assigned Japanese Patent Applications Nos. 333110/1988, 650/1989 and 651/1989). Referring to FIG. 1 (although FIG. 1 illustrates the present invention, the same figure will be used for convenience in describing the disclosure of the above applications), a web 1 supported on both sides at point A by means of a pin tenter 2 is transported to a reversing section (I) 3*a* where it is reversed to change directions, and further travels to the next reversing section (II) 3*b* where it is reversed again to make another change in direction. Further, the web 1 passes to a separating section 4 where it leaves the pin tenter as it is pulled upward.

The above-described method of drying and transporting webs with an apparatus having multiple reversing sections has suffered from various disadvantages. First, the web is subjected to a very strong tension even if a slight lateral offset occurs on account of shrinkage. Thus, in the reversing sections, particularly in the reversing section (II) 3*b* where the web rotates with the piercing end of each pin facing inward, the web has a tendency to disengage from the pins so that the degree of the pins' piercing through the web is decreased. Secondly, the shrinking force developed in the web at the reversing sections tends to cause a difference in the transport path between the sides of the web and its central part, whereby the web will deflect toward the center of reversal during transport. This results in web deformation in a pin cushion shape. As a result, external forces act on both sides of the web where they are retained by pins in a different way than when the web is transported only linearly, which can potentially lead to web rupture. Thirdly, when the web is allowed to disengage from the pins at the separating section 4 by pulling it upward as in the earlier case, a strong force is exerted in the areas where the web is retained by pins when it is transported at increasing speeds, which also increases the chance of the web of rupturing at the separating section 4.

SUMMARY OF THE INVENTION

An object, therefore, of the present invention is to solve the aforementioned problems of the prior art by providing a web transport apparatus that will not cause the web to break due to exerting external forces in different ways on two lateral sides.

This and other objects of the present invention are attained by a transport apparatus comprising a group of pins that are studded on flat plates connected together to form a chain on either side of a web so that it is transported in multiple stages as it is retained on two lateral sides, which apparatus has an annular member that supports the web from the inside by means of pins in each of the reversing sections that rotate to reverse the direction of web transport, with the piercing end of each pin facing either inward or outward, the annular member having a central shaft located at the center of the locus of rotation of the flat plates and also having an outside diameter substantially equal to the diameter of the locus of rotation of the web. Preferably, the annular members rotate at the same speed as the web. There further may be provided a separating section at which the web is disengaged from the pins, which section is provided in the last reversing section which rotates with the piercing ends of pins facing outward. The annular member in the last reversing section preferably has an outside diameter equal to or greater than the diameter of the locus of rotation of the piercing ends of the pins.

The invention may also be practiced by a web transport apparatus having a group of pins that are studded on flat plates connected together to form a chain on either side of a web so that it is transported in multiple stages as it is retained on two lateral sides, which apparatus has equally spaced openings in the chain of flat plates in areas that are outward of pins in the direction of width, a separating section at which the web is disengaged from pins, which section is provided in the last reversing section which rotates with the piercing ends of pins facing outward, and a gear-like member provided in the separating section, the gear-like member having a central shaft located at the center of the locus of rotation of the flat plates and also having a large diameter that is defined by gear teeth and which is equal to the diameter of the locus of rotation of the piercing ends of pins, the gear teeth having a pitch that permits them to loosely fit into the openings.

BRIEF DESCRIPTION OF THE DRAWINGS

FIG. 2(*b*) is a rear view of the annular member shown in FIG. 2(*a*);

FIG. 2(*c*) is a side view of an annular member that is provided in another reversing section in the web transport apparatus of the present invention which rotates with the piercing ends of pins facing inward;

FIG. 2(*d*) is a rear view of the annular member shown in FIG. 2(*c*);

FIG. 3(*b*) is a front view showing the state in which the web is supported in a reversing section;

FIG. 3(*c*) is a front view showing the state in which the annular member in the leaving section starts to act effectively on the web;

FIG. 3(*d*) is a front view showing the state in which the web is completely disengaged from pins by means of the annular member in the separating section;

FIG. 3(*e*) is a front view showing the state in which the web is supported in another reversing section;

FIG. 5(*b*) is a partial front view of FIG. 5(*a*);

FIG. 5(*c*) is a side view of FIG. 5(*a*); and

DESCRIPTION OF THE PREFERRED EMBODIMENTS

The present invention will be described below in greater detail with reference to preferred embodiments thereof.

Figure 1:
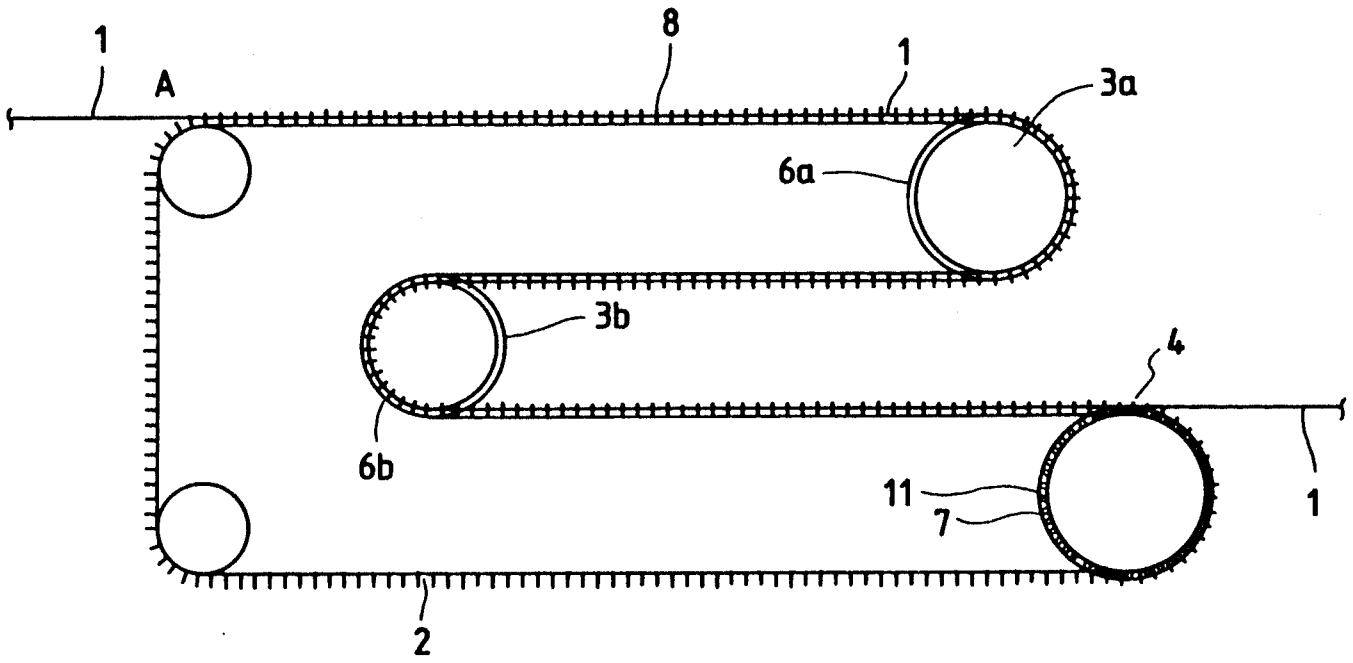
FIG. 1 is a schematic side view showing a web transport apparatus constructed according to a preferred embodiment of the present invention.
Figure 2A:
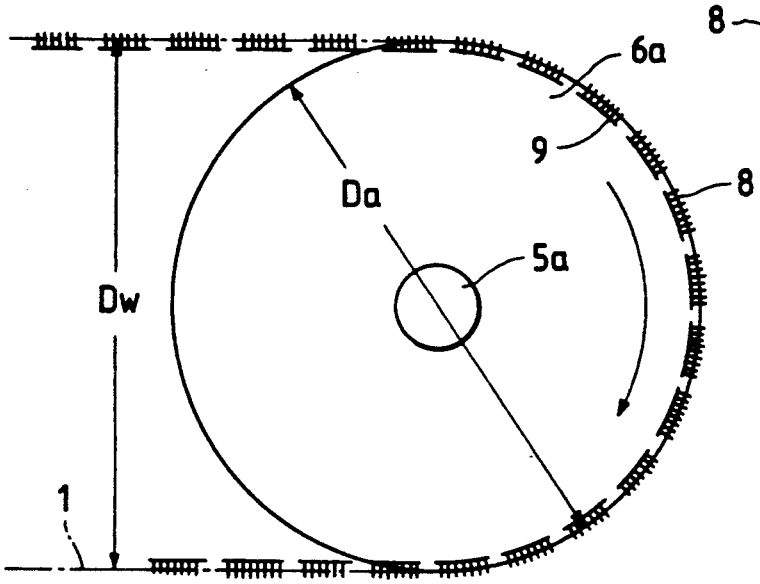
FIG. 2(*a*) is a side view of an annular member provided in a reversing section in the web transport apparatus of the present invention which rotates with the piercing ends of pins facing outward.
Figure 2B:
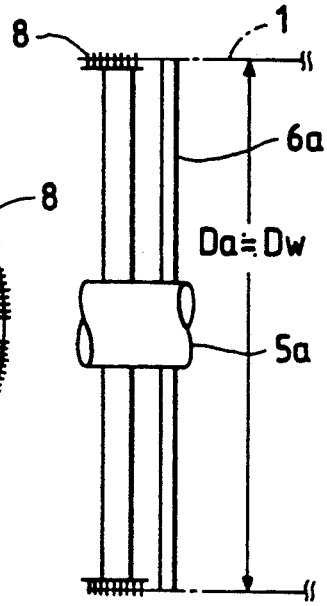
Figure 2C:
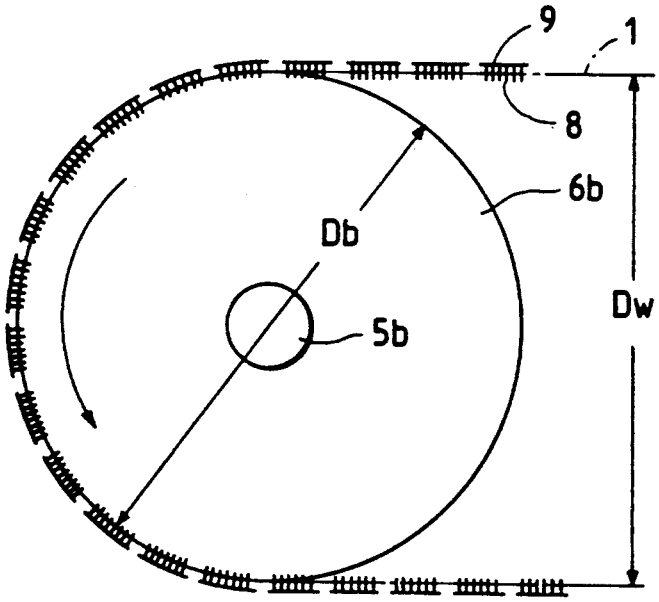
Figure 2D:
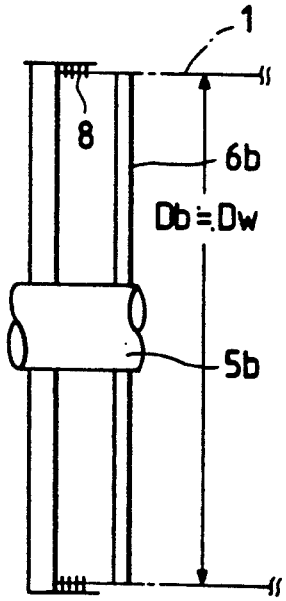
Figure 3A:
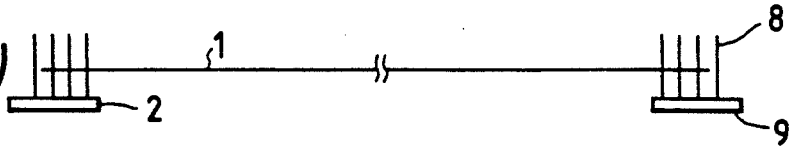
FIG. 3(*a*) is a front view showing the state in which the web is retained by pins in a steady manner in the web transport apparatus of the present invention.
Figure 3B:
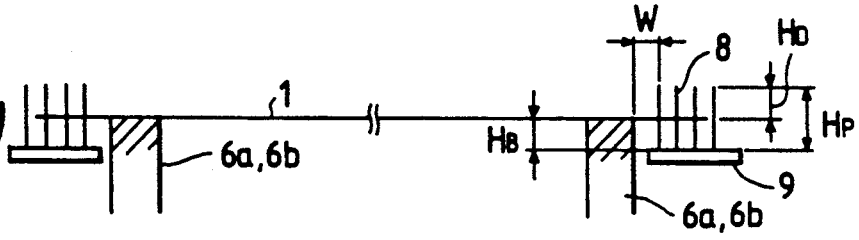
Figure 3C:
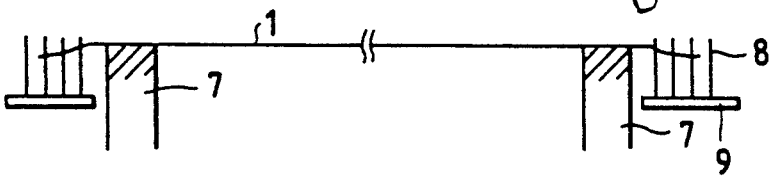
Figure 3D:
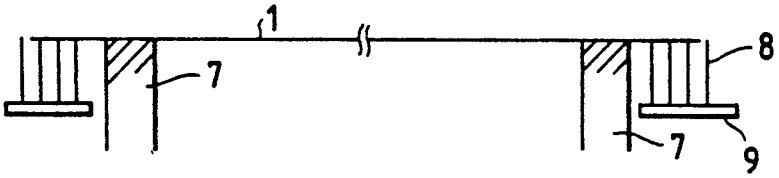
Figure 3E:
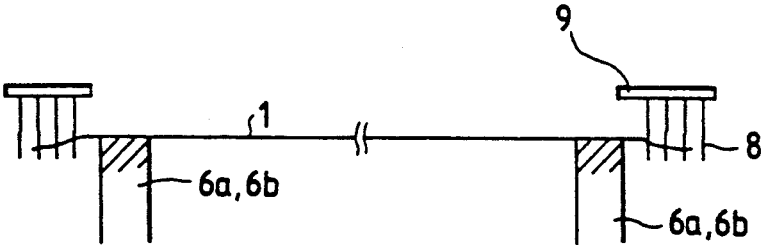

Reversing sections that rotate with the piercing ends of pins facing either inward or outward to reverse the direction of web transport are provided in the web transport apparatus of the present invention. Referring to FIG. 1, the reversing section (I) 3*a* and the separating section 4 are reversing sections that rotate with the piercing ends of pins facing outward; it is only the reversing section (II) 3*b* that rotates with the piercing ends of pins facing inward. The tenter 2 forms an endless loop that starts at point A, passes through reversing sections (I) and (II), and returns to point A via the separating section 4. In the example shown, the tenter has three reversing sections, but the number of reversing sections in the tenter may be increased to five or seven as required. The web is supported by the tenter at point A, and emerges from it at the separating section 4.

An annular member that has a central shaft located at the center of the locus of rotation of the flat plates, that has an outside diameter substantially equal to the diameter of the locus of rotation of the web, and that supports the web from inside by means of pins is also used in the present invention. FIGS. 2(*a*) and 2(*b*) are a side view and a partial front view, respectively, of such an annular member of a type that rotates with the piercing ends of pins facing outward, and FIGS. 2(*c*) and 2(*d*) are a side view and a partial front view, respectively, of an annular member of a type that rotates with the piercing ends of pins facing inward.

The annular member 6(*a*) (or 6*b*) in each reversing section has a central axis 5*a* (or 5*b*) located in the center of the locus of rotation of flat plates 9, has an outside diameter $D_a$ (or $D_b$) equal to the diameter of the locus of rotation of the web 1, and supports the web 1 from the inside by means of pins 8.

Being supported by these annular members 6*a* and 6*b* in the reversing sections, the web 1 maintains a constant and appropriate positional relationship with the pins 8, and thus will not cause any adverse effects due to lateral or vertical offsets. Further, the tension created by the shrinking web will be exerted uniformly on the pins.

In accordance with the present invention, the contact between the annular member 6*a* or 6*b* and the web permits the tension of shrinkage to be distributed uniformly in the direction of web travel. The outside diameter $D_a$ (or $D_b$) of the annular member 6*a* (6*b*) preferably satisfies the following conditions:

$$(D_w-5\text{ mm})\leqq D_a \text{ and } D_b\leqq(D_w+5\text{ mm})$$

where $D_w$ is the diameter of the locus of rotation of the web in the associated reversing section. In a more preferred case, $D_w$ is nearly equal to $D_a$ or $D_b$.

When a pin pierces through the web, the following conditions are preferably satisfied (see FIG. 3(*b*)):

$$H_D=H_B-H_p$$

$$-10\text{ mm}\leqq H_D\leqq 10\text{ mm}$$

$$2\text{ mm}\leqq W\leqq 20\text{ mm (desirably 5}-10\text{ mm)}$$

where $H_B$: the height of the web as measured from a flat plate;

$H_P$: the height of a pin on a flat plate;

$H_D$: the difference between $H_B$ and $H_P$; and

W: the gap between the innermost pin and the associated annular member in a reversing section.

In the present invention, the annular members 6*a* and 6*b* may be rotated at a peripheral speed equal to the web transport speed, which is preferred from the viewpoint of web transport since any outward force will be exerted upon the web. The annular members may be freely rotatable or they may be rotated with a motor.

In another embodiment of the present invention, the separating section at which the web is disengaged from the pins is provided in the last reversing section, which rotates with the piercing ends of pins facing outward. This corresponds to the case where the separating section is provided in the last reversing section shown in FIG. 2(*b*).

Figure 4:
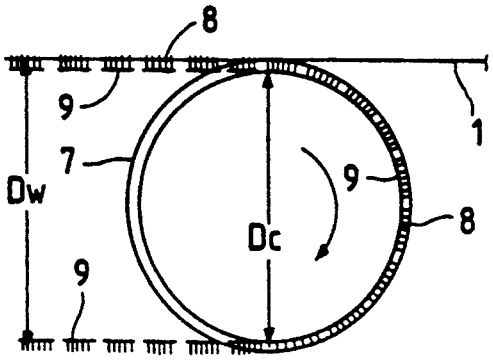
FIG. 4 is a side view of the separating section of the apparatus of the present invention at which the web is disengaged from pins.

In still another embodiment, the outside diameter of the annular member in the last reversing section is made equal to or greater than the diameter of the locus of rotation of the piercing ends of pins. This corresponds to the case where the separating section has a diameter $D_c$ which is greater than $D_a$ or $D_b$ of the other reversing sections, as shown by side view in FIG. 4.

Referring to FIGS. 3(*a*) to 3(*e*), the effects of this embodiment may be described as follows: FIG. 3(*a*) refers to a state in which the web is retained by means of pins in a steady manner; FIGS. 3(*b*) and 3(*e*) refer to cases where the web is supported by annular members 6*a* and 6*b* in reversing sections while they are still retained in a steady manner; FIG. 3(*c*) shows the state in which the annular member 7 in the separating section starts to work effectively on the web; and FIG. 3(*d*) shows state where the web 1 is completely disengaged from pins 8 by means of the annular member 7 ($H_D\simeq O$). In this way, the web leaving from pins 8 can be transported in a direction which is tangent to the highest point of the annular member 7 in the separating section. Furthermore, the web will be disengaged from the pins by means of the annular member 7 so slowly that tension will not concentrate on any single point where a pin is pierced through the web. Hence, the distortion that can occur in the web is not so marked as to rupture it.

Figure 5A:
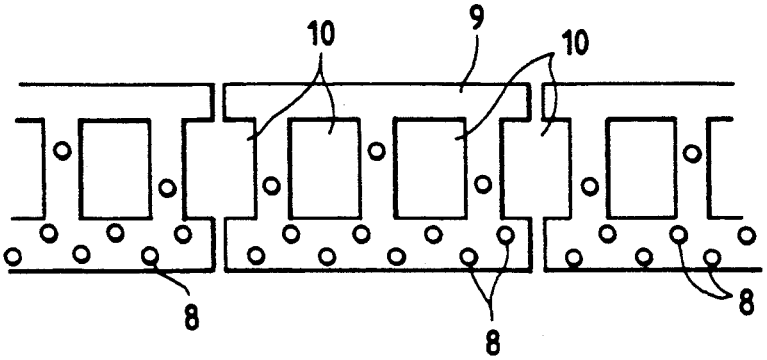
FIG. 5(*a*) is a plan view showing the case in which a gear-like member is used in the leaving section of the web transport apparatus of the present invention.
Figure 5B:
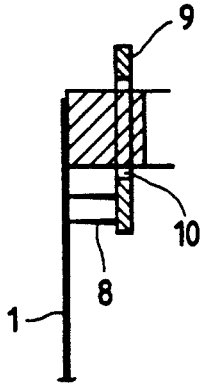
Figure 5C:
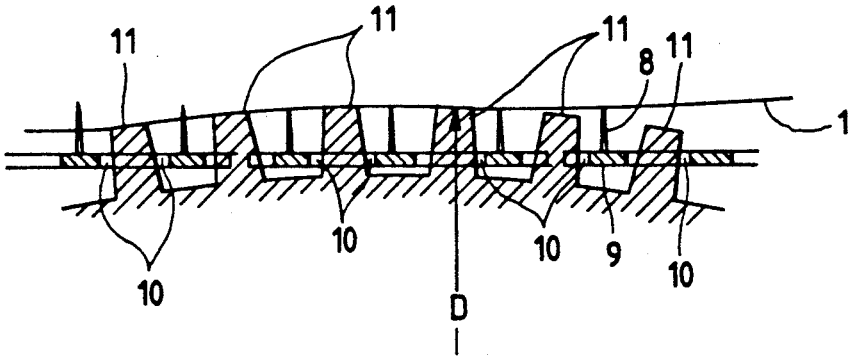

In a further embodiment of the present invention, equally spaced openings are provided in the chain of flat plates in areas that are outward of pins in the direction of width, as shown in FIG. 5(*a*), which is a plan view, FIG. 5(*b*), which is a front view, or in FIG. 5(*c*), which is a side view, in which equally spaced openings 10 ar provided in flat plates 9 in areas that are outward of pins 8 in the direction of width. In this embodiment, the separating section 4 at which the web 1 is disengaged from the pins 8 is provided in the last reversing section which rotates with the piercing ends of the pins facing outward, and a gear-like member is provided in the separating section. The gear-like member has a central shaft located at the center of the locus of rotation of the plates, and also having a large diameter D that is defined by the gear teeth and which is equal to the diameter of the locus of rotation of the piercing ends of pins, the gear teeth 11 having a pitch that permits them to loosely fit into the openings 10.

Figure 6:
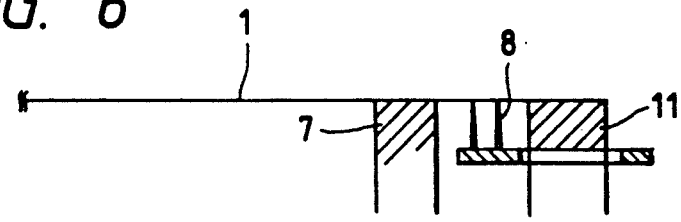
FIG. 6 is a front view showing the case where both an annular member and a gear-like member are used in the separating section of the web transport apparatus of the present invention.

In a still further embodiment, the gear-like member may be provided in the separating section at which the web is disengaged from pins 8 in such a way that the gear teeth 11 lie outwardly of the pins 8 while the annular member 7 lies inwardly of the pins 8 as shown in FIG. 6. This is effective in allowing the web to be disengaged very smoothly from the pins without causing any unwanted distortion in the web.

EXAMPLE

Webs were transported using the apparatus of the present invention of the type shown in FIG. 1, which had annular members 6*a* and 6*b* in reversing sections (I) 3*a* and (II) 3*b*, respectively, as well as an annular member 7 and a gear-like member having teeth 11 in a separating section 4. When webs are transported with the prior art apparatus, pins are likely to distort the web being transported, thereby increasing the chance of accidental dislodging of the web or its rupture. These risks were found to be entirely absent from the apparatus of the present invention, and the drying and transport speed could be increased without causing any marked distortion that would lead to web rupture. Thus, satisfactory products could be obtained.

The web transport apparatus of the present invention enables webs to be transported at high speed without causing them to break by exerting external forces in different ways on two lateral sides. This contributes greatly to improvements in the efficiency of drying and transporting webs.

What is claimed is:

1. A web transport apparatus which comprises on each lateral side of a web to be transported to a group of pins that are studded on flat plates connected together to form a chain for transporting the web, said apparatus further comprising a chain supporting member which supports said flat plates in a reversing section where the direction of chain transport is reversed and an annular member that is laterally offset from said supporting member in the direction of the center portion of the web, said annular member supporting the web in the reversing section where the direction of chain transport is reversed, said annular member having a central shaft located at the reversing section and having an outside diameter substantially equal to a diameter of the web, the web diameter being measured in the reversing section in a plane substantially defined by points where said pins contact the web.

2. The web transport apparatus according to claim 1, wherein said annular member rotates at a circumferential speed substantially equal to the speed of the transported web.

3. The web transport apparatus according to claim 1, wherein said apparatus has a plurality of reversing sections and one of said reversing sections is a separating section where the web is disengaged from said pins, said pins having piercing ends facing outward in relation to a rotational center of the separating section, and said annular member being disposed in the separating section and having an outside diameter equal to or greater than a diametrical distance between said piercing ends of said pins, the diametrical distance being measured in the separating section.

4. The web transport apparatus according to claim 3, further comprising a gear-like member in the separating section at which the web is disengaged from said pins, said gear-like member having a central shaft located in the separating section and having a diameter defined by extremities of gear teeth disposed on said gear-like member which is equal to the diametrical distance between said piercing ends of said pins, said gear teeth having a pitch that permits them to loosely fit into equally spaced openings provided in said flat plates.

5. The web transport apparatus according to claim 1, wherein said apparatus comprises a plurality of reversing sections and a plurality of annular members, and, in each of the reversing sections in which said pins face outward in relation to a rotational center of each of the reversing sections:

$$(D_w - 5\text{ mm}) \leqq D_a$$

and in each of the reversing sections in which said pins face inward in relation to the rotational center of each of the reversing sections:

$$D_b \leqq (D_w + 5\text{ mm})$$

where $D_w$ is the web diameter in the corresponding reversing section, $D_a$ is the outside diameter of said annular member in the corresponding reversing section in which said pins face outward, and $D_b$ is the outside diameter of said annular member in the corresponding reversing section in which said pins face inward.

6. The web transport apparatus of claim 1, wherein, where at least one of said pins contacts the web, the following conditions are satisfied:

$$H_D = H_S - H_p$$

$$-10\text{ mm} \leqq H_D \leqq [10\text{ mm}]0$$

$$2\text{ mm} \leqq W \leqq 20\text{ mm}$$

where $H_S$: a height of the web as measured from one of said flat plates;

$H_p$: a height of said pins on said one of said flat plates;

$H_D$: a difference between $H_B$ and $H_p$; and

W: a gap between a pin nearest an associated annular member and said associated annular member when said pin is positioned in a reversing section.

7. The web transport apparatus of claim 6, wherein $5\ mm \leqq W \leqq 10\ mm$.

8. In a web transport apparatus which comprises a group of pins that are studded on flat plates connected together to form a chain on either side of a web so that it is transported in multiple stages as it is retained on two lateral sides, the improvement wherein equally spaced openings are formed in the chain of flat plates in areas that are outward of said pins in the direction of width, and said apparatus comprises a separating section at which the web is disengaged from said pins, which section is provided in a last reversing section wherein piercing ends of said pins face outward, and a gear-like member provided in said separating section, said gear-like member having a central shaft located at the center of the locus of rotation of said flat plates and having a large diameter defined by gear teeth which is equal to the diameter of the locus of rotation of piercing ends of said pins, said gear teeth having a pitch that permit them to loosely fit into said openings.

9. A web transport apparatus for transporting a web having laterally opposing edges and a central portion, comprising:

a belt formed as an endless loop, said belt comprising a plurality of flat plates aligned end to end, said flat plates each having a plurality of pins with piercing ends for grasping said web affixed thereto, said pins all having their piercing ends facing outwardly from said belt in substantially the same direction;

a plurality of belt-supporting members, at least one of said belt-supporting members being disposed in a reversing section in which the direction of web transport is altered; and at least one annular member disposed in the reversing section, said annular member being laterally offset, in the direction of the center portion of the web, from said one of said belt-supporting members; wherein said annular member has a diameter substantially equal to a diametrical distance between the piercing ends of said pins, the diametrical distance being measured while said pins are positioned in the reversing section.

10. A web transport apparatus as recited in claim 9, further comprising a second of said belts, such that each of said belts grasps the web near one of the web's respective opposing edges for transporting the web.

11. A web transport apparatus as recited in claim 9, wherein said belt-supporting members are formed as wheels, said belt traveling along a circumferential sector of each of said belt supporting members.

12. A web transport apparatus as recited in claim 11, wherein said wheels have gear teeth disposed thereon which engage said flat plates to transport said belt.

* * * * *